US011714368B2

(12) United States Patent
Hasegawa et al.

(10) Patent No.: US 11,714,368 B2
(45) Date of Patent: Aug. 1, 2023

(54) FIXING UNIT

(71) Applicant: CANON KABUSHIKI KAISHA, Tokyo (JP)

(72) Inventors: Mitsuru Hasegawa, Ibaraki (JP); Hiroki Kawai, Chiba (JP); Ayano Ogata, Ibaraki (JP); Yasuharu Toratani, Chiba (JP); Suguru Takeuchi, Chiba (JP); Youichi Chikugo, Chiba (JP); Hidekazu Tatezawa, Saitama (JP); Yutaro Tsuno, Tokyo (JP); Kenichi Tanaka, Ibaraki (JP); Rikiya Takemasa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/706,448

(22) Filed: Mar. 28, 2022

(65) Prior Publication Data

US 2022/0308508 A1 Sep. 29, 2022

(30) Foreign Application Priority Data

Mar. 29, 2021 (JP) ..... 2021-054576

(51) Int. Cl.
*G03G 15/20* (2006.01)
*G03G 15/00* (2006.01)

(52) U.S. Cl.
CPC ..... *G03G 15/2025* (2013.01); *G03G 15/2046* (2013.01); *G03G 15/5029* (2013.01); *G03G 2215/00742* (2013.01)

(58) Field of Classification Search
CPC ..... G03G 15/2025; G03G 15/2046; G03G 15/5029; G03G 2215/00738; G03G 2215/00742
See application file for complete search history.

(56) References Cited

U.S. PATENT DOCUMENTS

2009/0297186 A1* 12/2009 Fromm ..... G03G 15/2025 399/45
2010/0189450 A1* 7/2010 Hosoda ..... G03G 15/6594 399/45

(Continued)

FOREIGN PATENT DOCUMENTS

JP 2004212409 A 7/2004

*Primary Examiner* — Carla J Therrien
(74) *Attorney, Agent, or Firm* — Canon U.S.A., Inc. I.P. Division

(57) ABSTRACT

An image forming apparatus includes a heating rotary member, a pressure rotary member, a nip portion formed by the rotary members, a temperature adjustment control section controlling a temperature of the heating rotary member to a target temperature, a cleaning web removing toner adhering to the heating rotary member, and a controller selectively executing one of a cleaning mode and a non-cleaning mode. A first basis weight and a second basis weight greater than the first predetermined basis weight are set, in a job that mixedly uses recording media with the first and second basis weights. When the controller executes the non-cleaning mode, the temperature adjustment control section sets a target temperature of a recording medium with a basis weight less than or equal to the first basis weight to a temperature lower than a target temperature of the recording medium in the cleaning mode.

4 Claims, 9 Drawing Sheets

(56) References Cited

U.S. PATENT DOCUMENTS

| | | | | |
|---|---|---|---|---|
| 2013/0343773 | A1* | 12/2013 | Monahan | G03G 15/2025 399/45 |
| 2019/0294086 | A1* | 9/2019 | Saito | G03G 15/5016 |
| 2020/0041940 | A1* | 2/2020 | Kawai | G03G 15/2025 |
| 2020/0073314 | A1* | 3/2020 | Tamaki | G03G 15/2025 |
| 2021/0223723 | A1* | 7/2021 | Chikugo | G03G 21/0041 |

* cited by examiner

FIG. 5

| FIXING UNIT TEMPERATURE [°C] | 150 | 155 | 160 | 165 | 170 | 175 | 180 |
|---|---|---|---|---|---|---|---|
| 64 gsm | GOOD | GOOD | GOOD | GOOD | GOOD | GOOD | GOOD |
| 81 gsm | POOR | POOR | GOOD | GOOD | GOOD | GOOD | GOOD |
| 104 gsm | POOR | POOR | POOR | GOOD | GOOD | GOOD | GOOD |
| 300 gsm | POOR | POOR | POOR | POOR | GOOD | GOOD | GOOD |
| 350 gsm | POOR | POOR | POOR | POOR | POOR | POOR | GOOD |

FIG. 6

| RECORDING MATERIAL BASIS WEIGHT [gsm] | 64–75 | 76–90 | 91–105 | 106–300 | 301–350 |
|---|---|---|---|---|---|
| TARGET FIXING TEMPERATURE [°C] | 150 | 160 | 165 | 170 | 180 |
| REFLECTION DENSITY DIFFERENCE | 0.18 | 0.18 | 0.12 | 0.10 | — |

FIG. 7

| RECORDING MATERIAL BASIS WEIGHT [gsm] | 64–75 | 76–90 | 91–105 | 106–300 | 301–350 |
|---|---|---|---|---|---|
| TARGET FIXING TEMPERATURE [°C] | 170 | 170 | 170 | 170 | 170 |
| REFLECTION DENSITY DIFFERENCE | 0.70 | 0.50 | 0.21 | 0.10 | — |

FIXING UNIT

BACKGROUND

Field of the Disclosure

The present disclosure relates to a fixing unit that fixes a toner image on a recording medium.

Description of the Related Art

The image forming apparatus includes a fixing unit that fixes an unfixed toner image on a recording medium.

The fixing unit includes a rotary member pair made up of a heating rotary member that applies heat to unfixed toner and that is rotationally driven, and a pressure rotary member that forms a nip portion with the heating rotary member by pressurizing the heating rotary member and that is rotationally driven. When a recording medium having unfixed toner is conveyed to the nip portion, the heat from the heating rotary member and the pressure generated by the pressure rotary member are applied to the recording medium. As a result, the unfixed toner is fixed on the recording medium.

In this way, in a manner of fixing toner on a recording medium by applying heat and pressure, the amount of heat for fixing a toner image on a recording medium varies according to the basis weight of the recording medium. For this reason, when recording media with different basis weights are successively passed through the fixing unit, a fixing temperature is changed according to the basis weight. Generally, an image forming process needs to be temporarily stopped at the time of changing the fixing temperature. Therefore, productivity decreases each time the basis weight of a recording medium to be passed through the fixing unit varies.

There is also a method of passing a recording medium at a constant fixing temperature regardless of the basis weight of the recording medium in order not to decrease productivity.

However, when the fixing temperature is constant, excessive heat is applied to a recording medium with a predetermined basis weight or less, with the result that a phenomenon called hot offset occurs. Furthermore, a phenomenon called cold offset occurs for a recording medium with a particularly large basis weight.

Toner remaining on a fixing belt due to hot offset or cold offset (offset toner) may adhere to a subsequent recording medium, with the result that the quality of an image formed on the subsequent recording medium may be decreased.

Therefore, a cleaning mechanism for collecting offset toner is used (Japanese Patent Laid-Open No. 2004-212409). Toner on the surface of the heating rotary member is collected by the cleaning mechanism.

A cleaning web (hereinafter, abbreviated as web) made of nonwoven fabric or the like is used in cleaning for collecting offset toner. A web is in a roll shape, and a web used to collect offset toner is taken up. Therefore, when a usable area of the web runs out, the web needs to be replaced with a new web. Until the web is replaced with a new web, an image forming process is stopped. Since replacement of the web is mainly performed by a serviceman, an image forming process remains stopped from when a serviceman is called to when replacement completes.

SUMMARY

Aspects of the present disclosure allow continuation of an image forming process without decreasing the quality of an image even when offset toner cannot be collected by a web.

An image forming apparatus includes: a heating rotary member arranged to heat an unfixed toner image born on a recording medium; a pressure rotary member arranged to pressurize the heating rotary member; a nip portion formed by the pressure rotary member and the heating rotary member and arranged to, when a recording medium bearing a toner image is conveyed to the nip portion, fix the toner image on the recording medium; a temperature adjustment control section configured to control a temperature of the heating rotary member such that the temperature of the heating rotary member becomes a target temperature; a cleaning web arranged to remove toner adhering to the heating rotary member; and a controller configured to selectively execute one of a cleaning mode in which the cleaning web cleans toner during image formation and a non-cleaning mode in which the cleaning web does not clean toner during image formation; a first predetermined basis weight and a second predetermined basis weight greater than the first predetermined basis weight are set, in a job that mixedly uses a recording medium with the first predetermined basis weight and a recording medium with the second predetermined basis weight, when the controller executes the non-cleaning mode, the temperature adjustment control section is configured to set a target temperature of a recording medium with a basis weight less than or equal to the first predetermined basis weight to a temperature lower than a target temperature of the recording medium in the cleaning mode.

Further features of the present disclosure will become apparent from the following description of exemplary embodiments with reference to the attached drawings.

BRIEF DESCRIPTION OF THE DRAWINGS

FIG. 5 is a table showing conditions under which cold offset occurs.

FIG. 6 is a table showing a target fixing temperature for a recording medium basis weight when a non-cleaning mode is applied.

FIG. 7 is a table showing a target fixing temperature for a recording medium basis weight when a cleaning mode is applied.

DESCRIPTION OF THE EMBODIMENTS

Image Forming Apparatus

Figure 1:
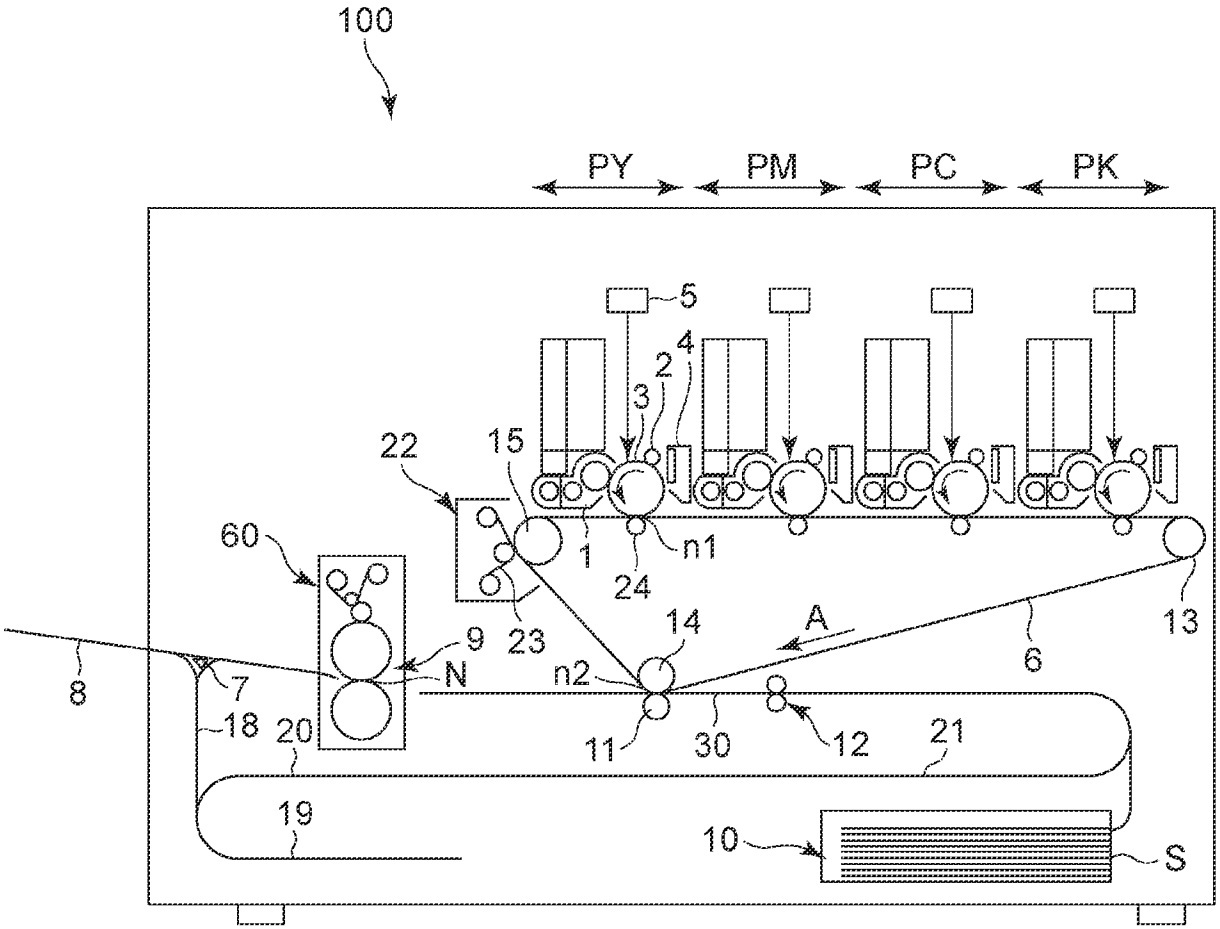
FIG. 1 is a schematic diagram showing the configuration of an image forming apparatus.

FIG. 1 is a schematic diagram showing the configuration of an image forming apparatus 100, As shown in FIG. 1, the image forming apparatus 100 includes four-type yellow, magenta, cyan, and black image forming units arranged in the moving direction of an intermediate transfer belt 6. First, a process in which a toner image is formed on the intermediate transfer belt 6 will be described by taking the yellow image forming unit PY as an example.

The surface of a rotationally driven photoconductor drum 3 is uniformly charged by a charger 2 (charging). After that, an exposure unit 5 applies laser to the surface of the photoconductor drum 3 according to input image data, and an electrostatic latent image is formed on the surface of the photoconductor drum 3 (exposure). After that, a yellow toner image is formed on the photoconductor drum 3 by a development unit 1 (development). A primary transfer roller 24 applies a voltage in reverse polarity to the polarity of the potential of the yellow toner image to the intermediate transfer belt 6. Thus, yellow toner on the photoconductor drum 3 is transferred to the intermediate transfer belt 6 (primary transfer). Yellow toner not transferred and remaining on the surface of the photoconductor drum 3 is scraped by a toner cleaner 4 and removed from the surface of the photoconductor drum 3. The series of processes is similarly performed for magenta, cyan, and black. As a result, a full-color toner image is formed on the intermediate transfer belt 6.

The toner image on the intermediate transfer belt 6 is transferred to a secondary transfer unit n2 made up of a secondary transferring roller pair 11, 14, In synchronization with the timing at which the toner image is conveyed, a recording medium A is taken out one by one from a recording medium cassette 10 and is fed to the secondary transfer unit n2. Then, the toner image on the intermediate transfer belt 6 is transferred to the recording medium A (secondary transfer). Specific examples of the recording medium A include plain paper, resin sheet, coated paper, thick paper, and overhead projector sheet. The basis weights of these recording media vary.

The recording medium A on which the toner image has been transferred is conveyed to a fixing unit 9 and fixed by receiving heat and pressure at the fixing unit 9 (fixing). The recording medium A on which the toner image has been fixed is discharged to an output tray 8.

The image forming apparatus 100 is also capable of forming a monochrome image. When a monochrome image is formed, only the black image forming unit PK out of the plurality of image forming units is driven.

Double-sided printing in which an image is formed on each side of a recording medium will be described. The recording medium A with an image on one side is discharged from the fixing unit 9 and then guided to a paper path 18 by a flapper 7.

When the recording medium A is conveyed from the paper path 18 to a reverse path 19, the recording medium A is conveyed to switch back on the reverse path 19. After that, the recording medium A passes through a double-sided printing path 20 and is conveyed to the paper path 21. At this time, the recording medium A is reversed upside down. After that, the recording medium A is conveyed again to the secondary transfer unit n2, and, when a toner image is transferred to the recording medium A, the toner image is fixed by the fixing unit 9. Then, the recording medium A subjected to double-sided printing is discharged to an output tray 8.

This process beginning with charging and ending with discharging of a recording medium A, on which a toner image has been fixed, to the output tray 8 is referred to as image forming process (print job). A period during which image formation is being performed is referred to as during image forming process (during print job).

Fixing Unit

Figure 2:
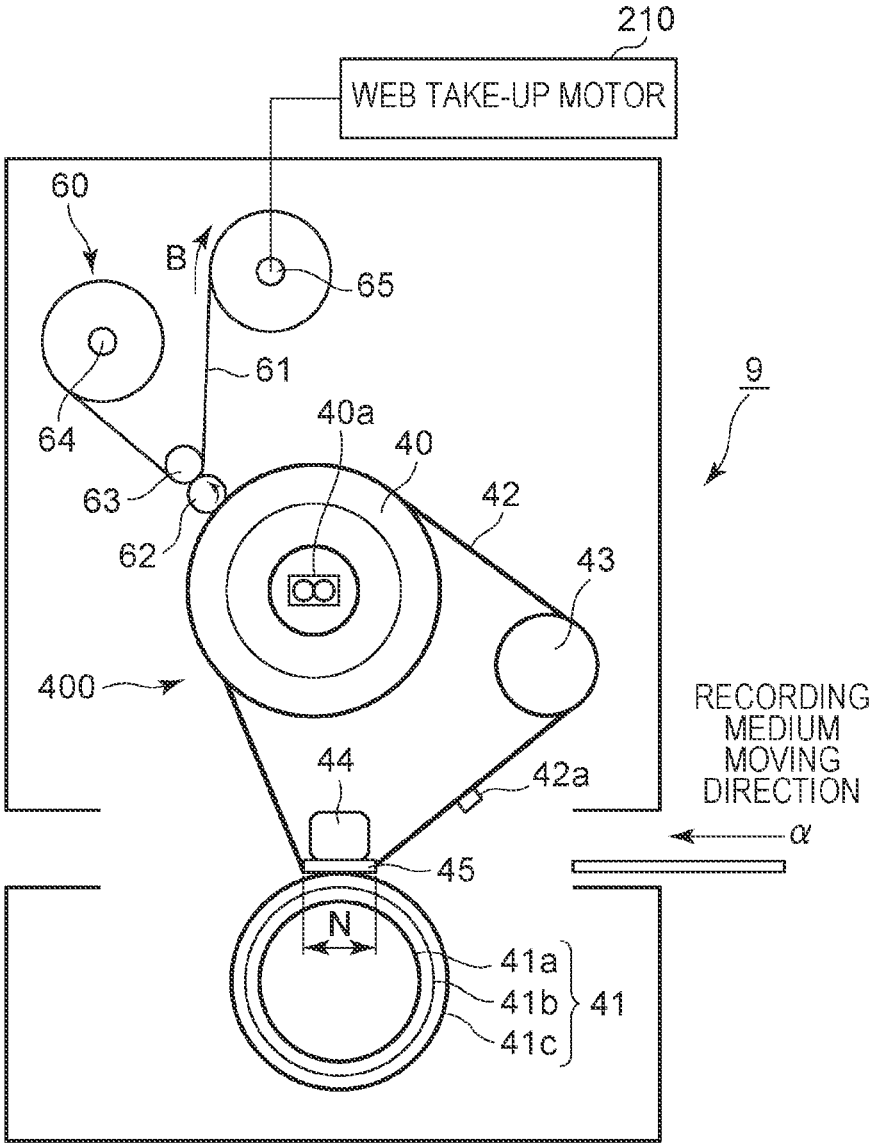
FIG. 2 is a schematic diagram of the cross section of a fixing unit.
Figure 3:
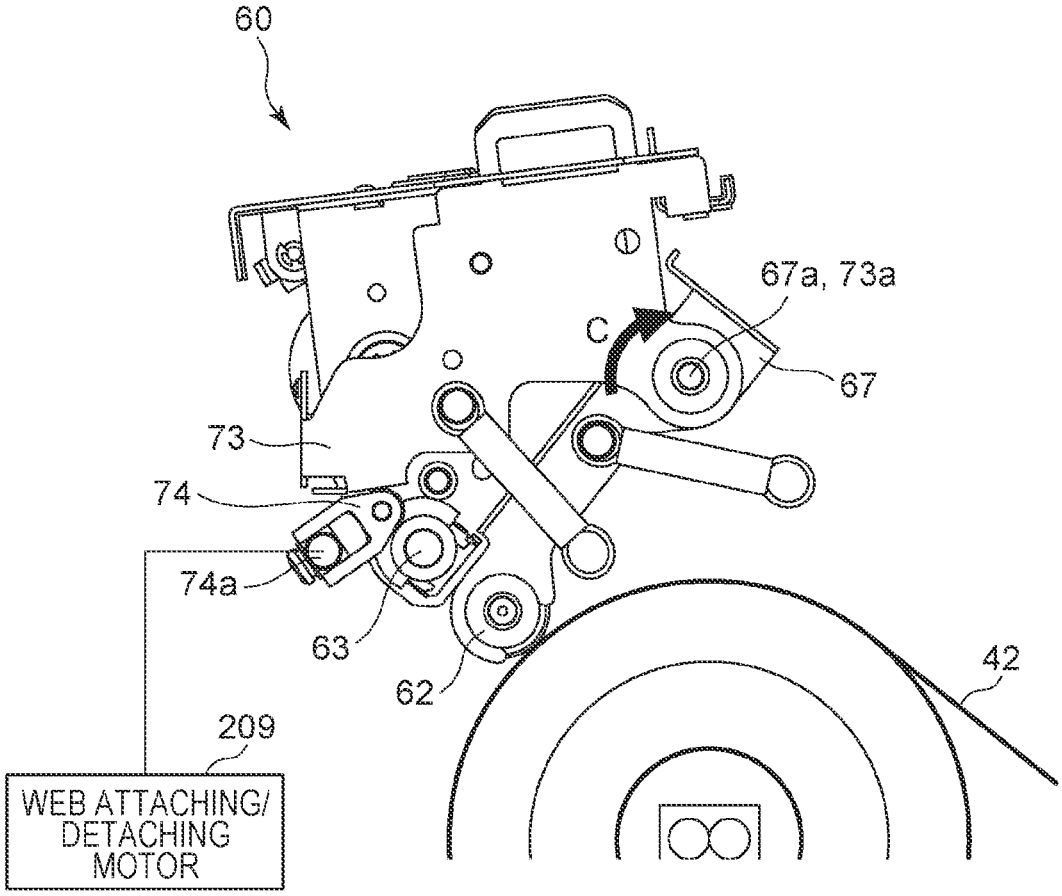
FIG. 3 is a schematic diagram of a cleaning mechanism.

Next, the fixing unit 9 according to the present embodiment will be described with reference to FIGS. 2 and 3. FIG. 2 is a sectional view showing the configuration of the fixing unit 9, FIG. 3 is a sectional view showing a cleaning mechanism 60.

In the present embodiment, the fixing unit 9 using an endless fixing belt 42 is adopted. In FIG. 2, a recording medium is conveyed in a direction indicated by the arrow α. The fixing unit 9 includes a heating rotary member 400 having the fixing belt 42, and a pressure rotary member 41 that forms a nip portion N with the fixing belt 42 by contacting with the fixing belt 42 and applying pressure to the fixing belt 42.

The heating rotary member 400 includes the fixing belt 42, a steering roller 43, a fixing pad 45 that is a pad member, and a heating roller 40. The fixing pad 45 and the heating roller 40 are disposed inside the fixing belt 42. The fixing belt 42 is stretched by the fixing pad 45 and the heating roller 40.

The heating roller 40 is formed in a cylindrical shape from a metal, such as aluminum and stainless steel.

In the present embodiment, the heating roller 40 is formed from an aluminum pipe with an outside diameter of 80 mm. A halogen heater 40*a* that serves as a unit of heating the fixing belt 42 is installed inside the heating roller 40. The heating roller 40 is heated to a predetermined temperature by the halogen heater 40*a*. The fixing belt 42 is heated by the heating roller 40 heated by the heat of the halogen heater 40*a*. The fixing belt 42 is controlled to a predetermined target temperature according to the basis weight of a recording medium on which a toner image is to be fixed, in accordance with a temperature detection result from a fixing temperature detecting sensor 42*a*.

A heater is not limited to a halogen heater and may be, for example, configured to heat the heating roller 40 by electromagnetic induction heating (IH).

The fixing belt 42 has a heat conductivity and a heat resistance and has, for example, a thin-walled cylindrical shape with an inside diameter of 120 mm. In the present embodiment, the fixing belt 42 has a three-layer structure in which a base layer, an elastic layer outside the base layer, and a release layer outside the elastic layer. The base layer is a polyimide resin (PI) with a thickness of 60 μm. The elastic layer is made of silicone rubber with a thickness of 300 μm. The release layer is made of PFA (tetrafluoroethylene-perfluoroethylene copolymer resin) as a fluororesin with a thickness of 30 μm. The fixing belt 42 is driven to rotate when a pressure rotary member 41 (described later) contacts with the fixing belt 42 and is rotationally driven.

The fixing pad 45 is disposed on the inner peripheral surface of the fixing belt 42 so as to face the pressure rotary member 41 via the fixing belt 42. The fixing pad 45 is supported by a stay 44 that supports the fixing pad 45. The stay 44 is disposed so as to face the pressure rotary member 41 via the fixing pad 45 and is brought into contact with the fixing pad 45. The stay 44 is to form the nip portion N by imparting strength to the fixing pad 45 at the time when the fixing pad 45 receives pressure from the pressure rotary member 41.

The pressure rotary member 41 is to form the nip portion N by applying pressure to the fixing pad 45. The pressure rotary member 41 has a cylindrical aluminum metal core 41*a*, an elastic layer 41*b* with a thickness of 1 mm on the outer side of the metal core 41*a*, and a release layer 41*c* for enhancing releasability from toner on the outer side of the elastic layer 41*b*.

The pressure rotary member 41 is pressurized toward the fixing pad 45 via the fixing belt 42 in a direction perpendicular to the paper conveying direction α. Thus, the nip portion N is formed. In the present embodiment, the pressure rotary member 41 is pressurized with a total pressure of 784 N (about 80 kgf), and the width of the nip portion N is 24 mm. The pressure rotary member 41 is rotationally driven in an arrow L direction. Therefore, the fixing belt 42 sandwiched by the pressure rotary member 41 and the fixing pad 45 is driven to rotate by the rotational drive of the pressure rotary member 41.

As described above, the recording medium A bearing an unfixed toner image is nipped and conveyed by the heating rotary member 400 and the pressure rotary member 41, receives heat and pressure, and is subjected to fixing.

Cleaning Mechanism

The cleaning mechanism 60 will be described with reference to FIG. 2. The cleaning mechanism 60 is a cleaning mechanism for removing offset toner adhering to the surfaces of the rotary member pair made up of the heating rotary member 400 and the pressure rotary member 41.

Here, the cleaning mechanism 60 that removes offset toner on the surface of the heating rotary member 400 will be described as an example. However, the cleaning mechanism 60 may be configured to remove offset toner on the surfaces of the rotary member pair. In other words, the cleaning mechanism 60 may be configured to remove offset toner on the surface of the pressure rotary member 41.

When excessive heat is applied to a recording medium A, toner on the recording medium A fuses excessively and remains on the heating rotary member 400. Phis phenomenon is called hot offset. When the amount of heat is insufficient for a recording medium A, toner on the recording medium A does not fuse and remains on the heating rotary member 400, This phenomenon is called cold offset.

Here, the phenomenon that toner remains on the heating rotary member 400 is called offset. Here, toner remaining on the heating rotary member 400 due to offset is called offset toner.

The amount of heat used to fix a toner image on a recording medium A to the recording medium A varies according to the basis weight of the recording medium A. As the basis weight of a recording medium A increases, the amount of heat used also increases. For this reason, when recording media A with different basis weights are successively passed through a fixing unit, a fixing temperature is changed in accordance with the basis weight. However, to change the fixing temperature, an image forming process needs to be temporarily stopped. For this reason, when recording media with different basis weights are successively passed through the fixing unit, productivity of the image forming process has decreased.

In order not to decrease the productivity of the image forming process, recording media with different basis weights have been passed through the fixing unit without temporarily stopping the image forming process by passing thin paper (recording medium with a small basis weight) through the fixing unit at a fixing temperature used at the time of passing thick paper (recording medium with a large basis weight) through the fixing unit.

However, when thin paper is passed through the fixing unit at a fixing temperature used at the time of passing thick paper through the fixing unit (thick paper fixing temperature), heat greater than or equal to the amount of heat for fixing a toner image is applied to the thin paper. Therefore, hot offset occurs. Toner remaining on the heating rotary member due to hot offset may adhere to a subsequent recording medium, with the result that the quality of an image formed on the subsequent recording medium may be decreased.

On the other hand, when thick paper is passed through the fixing unit at a fixing temperature used at the time of passing thin paper through the fixing unit (thin paper fixing temperature) in order to reduce offset and maintain the productivity of a print job, the amount of heat is not sufficient for thick paper, with the result that cold offset that toner remains on the surface of the heating rotary member 400 occurs. Toner remaining on the heating rotary member due to cold offset may adhere to a subsequent recording medium, with the result that the quality of an image formed on the subsequent recording medium may be decreased.

In order to prevent such an image defect due to offset toner, the cleaning mechanism 60 is provided. The cleaning mechanism 60 includes a collector roller 62 and a web 61 for collecting, toner.

The collector roller 62 contacts with the surface of the fixing belt 42 and is driven to rotate. Offset toner is fused by the heat of the halogen heater 40*a*. The collector roller 62 used in the present embodiment is a roller with an outside diameter of 20 mm and is made of stainless steel SUS303 having a higher affinity for fused toner than the release layer on the surface of the fixing belt 42. Therefore, fused toner is collected by the collector roller 62.

Offset toner collected by the collector roller 62 is removed from the collector roller 62 by the web 61 made up of nonwoven fabric or the like. The cleaning mechanism 60 includes a web roller 63 for pressing the web 61 against the collector roller 62. The web roller 63 contacts with the collector roller 62 via the web 61. Since the collector roller 62 is driven to rotate by the fixing belt 42, offset toner adhering to the collector roller 62 is removed from the collector roller 62 by the web 61.

The cleaning mechanism 60 includes a web delivery mechanism 64 and a web take-up mechanism 65. When the web 61 contacts with the collector roller 62 and the collector roller 62 contacts with the fixing belt 42, the web take-up mechanism 65 takes up the web 61 at a rate of 0.2 mm/s in an arrow B direction during image formation. An unused web is delivered from the web delivery mechanism 64, and a used web is taken up by the web take-up mechanism 65.

Contact and Separation Mechanism of Cleaning Mechanism

The cleaning mechanism 60 includes a contact and separation mechanism capable of contacting with and separating from the fixing belt 42. The contact and separation mechanism of the cleaning mechanism 60 will be described with reference to FIG. 3.

Initially, the separation mechanism with which the cleaning mechanism 60 separates the collector roller 62 and the fixing belt 42 from each other will be described.

The fixing belt 42 and the collector roller 62 are configured to be capable of contacting with and separating from each other. The cleaning mechanism 60 includes a web arm 73 that supports the web roller 63, an attaching/detaching cam 74 that contacts with the web arm 73, and an intermediate support arm 67 that supports the collector roller 62.

The attaching/detaching cam 74 is rotated about a rotation center 74*a* by a web attaching/detaching motor 209. Then, the web arm 73 that supports the web roller 63 rotates about a rotation fulcrum 73*a* and moves the web 61 and the web roller 63 such that the web 61 and the web roller 63 separate from the fixing belt 42. As a result of rotation of the attaching/detaching cam 74, the intermediate support arm 67 that supports the collector roller 62 rotates about a rotation fulcrum 67*a* in an arrow C direction. Thus, the collector roller 62 is separated from the fixing belt 42.

The collector roller 62 and the fixing belt 42 are brought into contact with each other when the web attaching/detaching motor 209 rotates the attaching/detaching cam 74 in a direction opposite to the arrow C direction.

Relationship Between Fixing Temperature and Hot Offset Amount

The relationship between fixing temperature and hot offset toner amount will be described with reference to FIG. 4.

Figure 4:
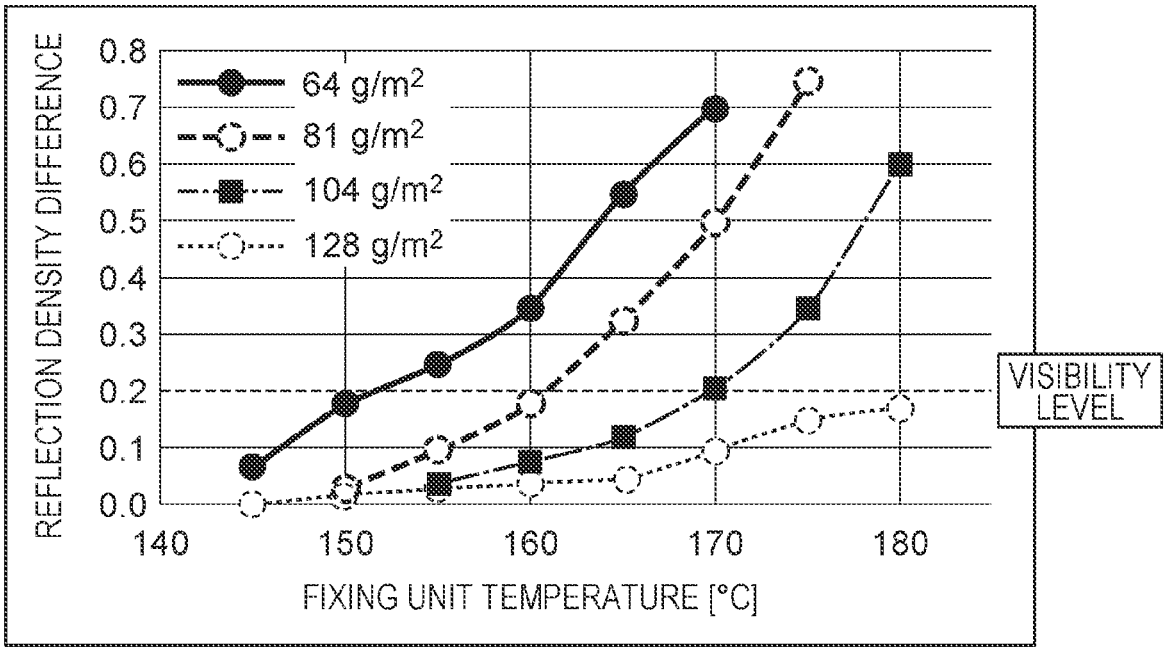
FIG. 4 is a graph showing a hot offset toner amount per basis weight of a recording medium.

FIG. 4 is a graph of experimental results showing the relationship of hot offset toner amount with target fixing temperature.

The basis weights of recording media used in the experiment of FIG. 4 were four types, that is, 64 gsm, 81 gsm, 104 gsm, and 128 gsm. The conveying speed was set to 300 mm/sec. In this experiment, the target fixing temperature was changed in steps of 5° C. within the range of 145° C. to 180° C., and a recording medium bearing an unfixed toner image was passed through the fixing unit 9.

In order to quantify the amount of offset toner adhering to a subsequent recording medium again, a reflection density difference was used. The reflection density difference quantifies the difference between reflection densities of a toner re-adhesion part and a recording medium white part, measured by a reflection densitometer. As the value of the reflection density difference increases, the re-adhered offset toner amount is presumably large. A reflection densitometer TC-6MC-D made by TokyoDenshoku Co., Ltd. was used for measurement.

The visibility level in FIG. 4 is a level at which a part where offset toner is re-adhered to a subsequent recording medium is visually recognized. When an offset toner amount that exceeds the visibility level occurs, there is a possibility that an image defect occurs in a subsequent recording medium. Therefore, in image formation, it is desired not to exceed a reflection density difference of 0.2.

As shown in FIG. 4, as the temperature of the fixing unit 9 increases, the reflection density difference increases. In addition, as the basis weight of a recording medium reduces, the reflection density difference increases.

When a recording medium with a basis weight of 64 gsm is passed through the fixing unit 9, an image defect due to hot offset is reduced when the fixing temperature is set to 150° C. or lower. Similarly, when a recording medium with a basis weight of 81 gsm, 104 gsm, or 128 gsm is passed through the fixing unit 9, an image defect due to hot offset is reduced by setting the fixing temperature to 160° C. or lower, 165° C. or lower, or 170° C. or lower.

The relationship between fixing temperature and cold offset toner amount will be described with reference to FIG. 5.

FIG. 5 is a table of experimental results showing the relationship of hot cold offset toner amount with target fixing temperature. The basis weights of recording media used in the experiment of FIG. 5 were five types, that is, 64 gsm, 81 gsm, 104 gsm, 300 gsm, and 350 gsm. The conveying speed was set to 300 mm/sec. In this experiment, the target fixing temperature was changed in steps of 5° C. within the range of 151° C. to 180° C., and a recording medium bearing an unfixed toner image was passed through the fixing unit 9.

"GOOD" in FIG. 5 indicates that a cold offset toner amount that does not exceed the visibility level has occurred or no cold offset has occurred. "POOR" indicates that a cold offset toner amount that exceeds the visibility level has occurred.

From the experimental results, when a recording medium with a basis weight of 64 gsm is passed through the fixing unit 9, an image defect due to cold offset is reduced when the fixing temperature is set to 150° C. or higher. Similarly, when a recording medium with a basis weight of 81 gsm, 104 gsm, 300 gsm, or 350 gsm is passed through the fixing unit 9, an image defect due to cold offset is reduced by setting the fixing temperature to 160° C. or higher, 165° C. or higher, 170° C. or higher, or 180° C. or higher.

From FIGS. 4 and 5, the fixing temperature is set such that an offset toner amount does not exceed 0.2 at which the visibility level is NG for the basis weight of a recording medium, and is shown in FIG. 6. Specifically, 150° C. is set for 64 gsm to 75 gsm, 160° C. is set for 76 gsm to 90 gsm, 165° C. is set for 91 gsm to 105 gsm, 170° C. is set for 106 gsm to 300 gsm, and 180° C. is set for 301 gsm to 350 gsm. Since the reflection density difference at the time when a recording medium with a basis weight of 301 gsm to 350 gsm is passed through the fixing unit at 180° C. is not measured in this experiment, "-" is written. With the conditions shown in FIG. 6, it is possible to reduce occurrence of an image defect on a subsequent recording medium.

Temperature Adjustment Control in Cleaning Mode

When the target fixing temperature of the fixing unit 9 is set to the temperatures shown in FIG. 6, and in the case of, for example, an image forming job that mixedly uses a recording medium with a basis weight of 64 gsm and a recording medium with a basis weight of 300 gsm, the fixing temperature needs to be changed from 150° C. to 170° C. or from 170° C. to 150° C. An image forming job needs to be temporarily stopped at the time of changing the fixing temperature.

The web 61 is made of nonwoven fabric with an overall length of about 50 m. The web take-up mechanism 65 takes up the web 61 at a rate of 0.2 mm/s during image formation. The cleaning mechanism 60 has a cleaning mode in which an image is formed while the surface of the fixing belt 42 is cleaned. The cleaning mode is applied to a case where an unused web 61 is able to be taken up by the web take-up mechanism 65.

In the present embodiment, when the cleaning mode is applied, a down time due to a fixing temperature change over time is reduced by setting a constant target fixing temperature regardless of the basis weight of a recording medium.

Specifically, the target fixing temperature is set to 170° C. regardless of the basis weight of a recording medium.

FIG. 7 shows a reflection density difference for each basis weight of a recording medium in the case of a fixing temperature of 170° C. When the basis weight of a recording medium is 64 gsm to 105 gsm, the reflection density difference exceeds 0.2; however, when the cleaning mode is applied, the surface of the fixing belt 42 is cleaned by the cleaning mechanism 60, Therefore, since offset toner on the surface of the fixing belt 42 is removed by cleaning with the cleaning mechanism 60 before offset toner adheres to a subsequent recording medium, an image defect is reduce.

Non-Cleaning Mode

The image forming apparatus 100 has a non-cleaning mode in which an image is formed even when an unused web 61 is not able to be taken up by the web take-up mechanism 65. However, generally, when an image is formed in the non-cleaning mode as well, a recording medium is passed through a fixing unit at a target fixing temperature used in the cleaning mode. In other words, since a constant target fixing temperature is set regardless of the basis weight of a recording medium, offset that decreases the quality of an image has been occurring.

According to the present embodiment, when an image is formed in the non-cleaning mode, a target fixing temperature of a recording medium with a basis weight less than or equal to a first predetermined basis weight is set to a target fixing temperature of the recording medium in the cleaning mode.

Here, the first predetermined basis weight is 105 gsm. When the basis weight of a recording medium is less than or equal to 105 gsm, the target fixing temperature is set to 165° C. When the basis weight of a recording medium is less than or equal to 90 gsm, the target fixing temperature is set to 160° C. When the basis weight of a recording medium is less than or equal to 75 gsm, the target fixing temperature is set to 150° C. Thus, the reflection density difference is suppressed to less than 0.2. Thus, occurrence of an image defect on a subsequent recording medium is reduced.

When a recording medium with a basis weight of greater than or equal to 106 gsm, which is greater than the first predetermined basis weight, is passed through the fixing unit, the target fixing temperature applied in the cleaning mode is set to 1.70° C.

When a recording medium with a basis weight of greater than or equal to 301 gsm that is the second predetermined basis weight is passed through the fixing unit, there is a possibility that cold offset occurs. Therefore, when a recording medium with a basis weight greater than or equal to the second predetermined basis weight is passed through the fixing unit, the recording medium is passed at a fixing temperature at which occurrence of cold offset is reduced. In the present embodiment, when a recording medium with a basis weight greater than or equal to the second predetermined basis weight is passed through the fixing unit, the target fixing temperature is set to 180° C.

Thus, it is possible to reduce occurrence of offset and reduce the possibility of occurrence of an image defect on a subsequent recording medium.

Control Section

Figure 8:
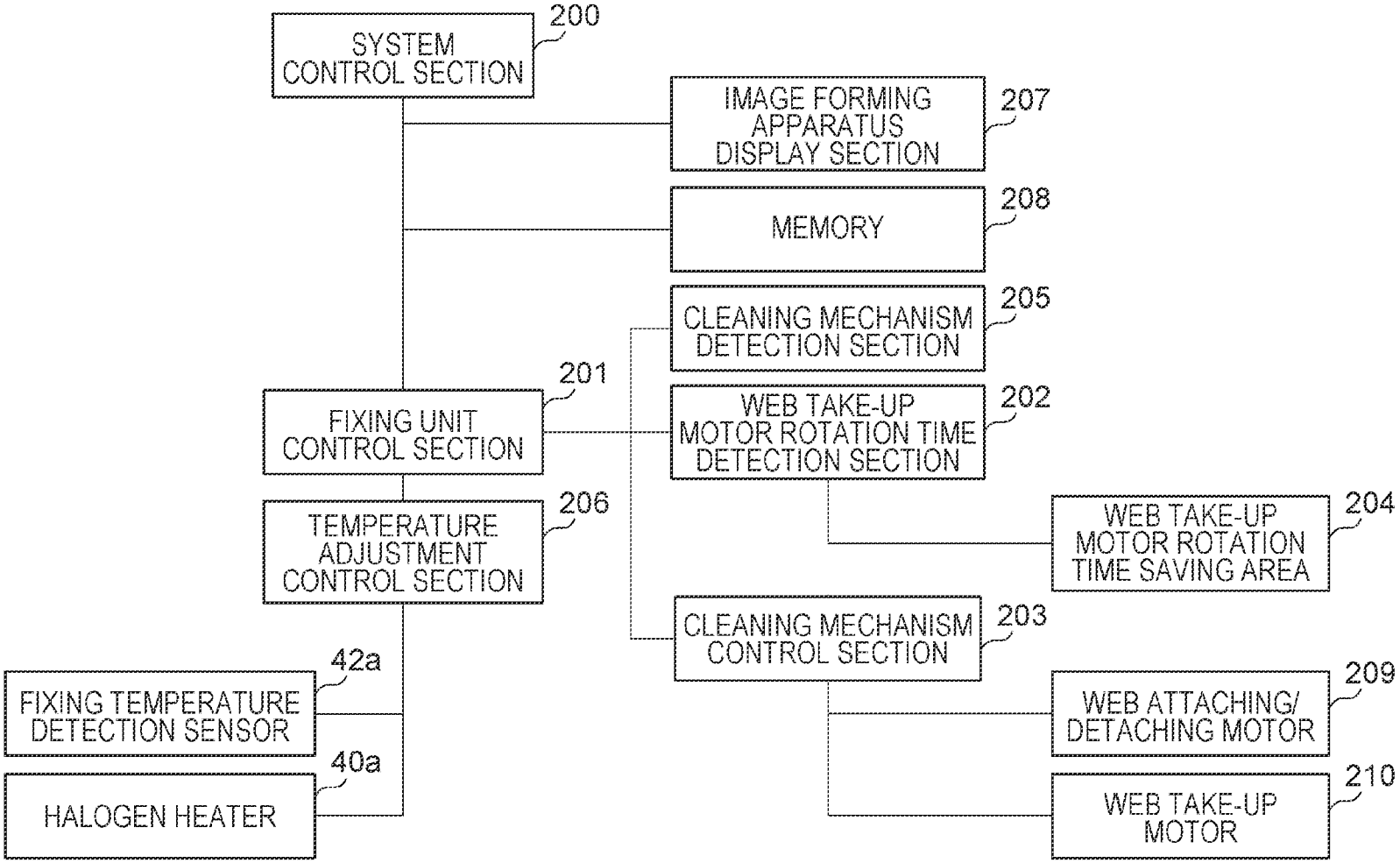
FIG. 8 is a block diagram showing a control system according to an embodiment.

Next, a control system according to the present embodiment will be described with reference to the block diagram of FIG. 8. The image forming apparatus 100 includes a system control section 200. The system control section 200 includes an image forming apparatus display section 207, a memory 208, and a fixing unit control section 201.

The image forming apparatus display section 207 is, for example, an operation panel or the like. When it is not possible to take up the web 61 with the web take-up mechanism 65, the system control section 200 displays a web replacement alarm on the image forming apparatus display section 207. Thus, the situation in which an image cannot be formed in the cleaning mode unless the web 61 is replaced with a new web is informed to a user who uses the image forming apparatus 100.

In S009 of a flowchart (described later), when the user selects to start printing in the non-cleaning mode, the system control section 200 causes the memory 208 to store a non-cleaning mode flag.

The image forming apparatus 100 includes a fixing unit control section 201 that controls contact and separation of the cleaning mechanism 60, performed in the fixing unit 9, and a target fixing temperature.

The fixing unit control section 201 includes a temperature adjustment control section 206, a cleaning mechanism detection section 205, a web take-up motor rotation time detection section 202, and a cleaning mechanism control section 203.

The cleaning mechanism detection section 205 is to determine whether the web 61 is mounted in the cleaning mechanism 60.

The cleaning mechanism control section 203 controls the web attaching/detaching motor 209 that rotates the attaching/detaching cam 74, and a web take-up motor 210 that takes up the web 61 by rotating the web take-up mechanism 65.

The web take-up motor rotation time detection section 202 has a web take-up motor rotation time saving area 204 and is provided in the fixing unit 9. In the web take-up motor rotation time saving area 204, a rotation accumulated value (Tw) of the web take-up motor 210, which is an accumulated value by which the web take-up mechanism 65 takes up the web 61, is saved.

When Tw reaches a predetermined value and the non-cleaning mode is applied, the system control section 200 causes the fixing unit control section 201 to change the target fixing temperature of the fixing unit 9 according to a basis weight.

The predetermined value of Tw here is a value at the time when the web take-up motor 210 is rotated until the web take-up mechanism 65 is not able to take up the web 61 any more.

The fixing unit control section 201 includes the temperature adjustment control section 206. The fixing temperature detecting sensor 42*a* and the halogen heater 40*a* are connected to the temperature adjustment control section 206. The fixing temperature detecting sensor 42*a* detects the temperature of the fixing unit 9. The halogen heater 40*a* is heated such that the temperature of the fixing unit 9 becomes a target fixing temperature in accordance with the detected temperature.

The system control section 200 transmits the basis weight of a recording medium to be passed through the fixing unit 9 to the temperature adjustment control section 206 via the fixing unit control section 201.

When an image is formed in the non-cleaning mode, the temperature adjustment control section 206 controls the halogen heater 40*a* such that the fixing unit 9 becomes a target fixing temperature in accordance with the transmitted basis weight of a recording medium.

Flowchart

Figure 9:
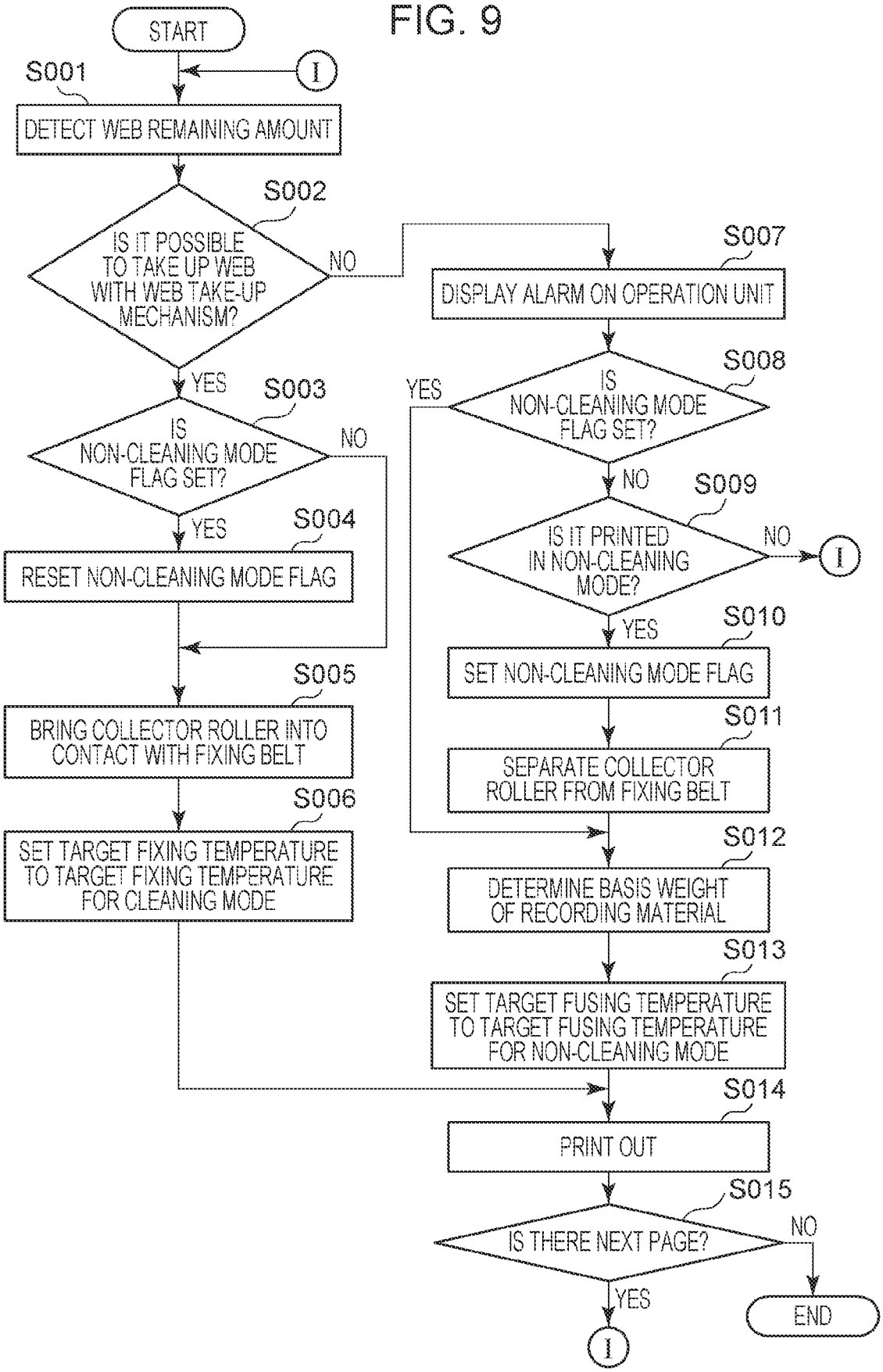
FIG. 9 is a flowchart showing control operations according to the present embodiment.

Control of the cleaning mechanism 60 during image formation according to the present embodiment will be described with reference to FIG. 9. The flowchart of FIG. 9 shows control operations that the system control section 200 causes the sections shown in FIG. 8, that is, the fixing unit control section 201, the temperature adjustment control section 206, and the like, to execute.

S001

The system control section 200 detects the remaining amount of the web 61 from the web take-up motor rotation time detection section 202.

S002

The system control section 200 determines whether the web take-up mechanism 65 is able to take up the web 61 from the detected remaining amount of the web 61. When the web take-up mechanism 65 is able to take up the web 61, the process proceeds to S003; otherwise, the process proceeds to S007.

S003

When the web take-up mechanism 65 is able to take up the web 61, the cleaning mode is executed. When it is the first time to form an image after the web 61 is replaced, the non-cleaning mode flag is set, so the system control section 200 determines whether the non-cleaning mode flag is stored in the memory 208. When the non-cleaning mode flag is stored in the memory 208, the process proceeds to S004; otherwise, the process proceeds to S005.

S004

The system control section 200 resets the non-cleaning mode flag stored in the memory 208 to execute the cleaning mode.

S005

The system control section 200 causes the cleaning mechanism control section 203 to rotate the web attaching/detaching motor 209 to thereby bring the collector roller 62 into contact with the fixing belt 42.

Thus, the cleaning mechanism 60 is able to clean the surface of the fixing belt 42.

S006

The system control section 200 causes the fixing unit control section 201 to set the target fixing temperature of the fixing unit 9 to 170° C. By unifying the target fixing temperature to 170° C., it is possible to reduce a temperature change over time and improve productivity in image formation.

S014

The system control section 200 executes an image forming (including fixing) process.

S015

The system control section 200 determines whether there is the next page subjected to image formation, and, when there is the next page, the process returns to S001. When there is no next page subjected to image formation, the image forming process is ended.

S007

When the web take-up mechanism 65 is not able to take up the web 61 in S002, it is not possible to continue execution of the cleaning mode, so the system control section 200 displays a web replacement alarm on the image forming apparatus display section 207. Thus, the situation in which an image cannot be formed in the cleaning mode unless the web 61 is replaced with a new web is informed to a user who uses the image forming apparatus 100.

The system control section 200 causes the image forming apparatus display section 207 to display a prompt to replace the web 61 with a new web, Specifically, the image forming apparatus display section 207 prompts the user to call a serviceman and displays a message requesting replacement of the web.

S008

The system control section 200 determines whether the non-cleaning mode flag is stored in the memory 208. When the non-cleaning mode flag is stored in the memory 208, it means that the non-cleaning mode has been already executed. Therefore, the process proceeds to S012. When the non-cleaning mode flag is not stored, the process proceeds to S009.

S009

The system control section 200 determines whether the user selects to form an image in the non-cleaning mode.

Specifically, the system control section 200 causes the image forming apparatus display section 207 to display a screen for prompting the user to select whether to form an image in the non-cleaning mode, and acquires the selected result of the user.

Alternatively, not the process of S009 is executed, but the system control section 200 may output a signal or the like to the image forming apparatus 100 such that the image forming apparatus 100 forcibly forms an image in the non-cleaning mode. In this case, it is possible to omit operation of the user on an operation panel or the like.

When an image is formed in the non-cleaning mode, the process proceeds to S010; whereas, when an image is not formed in the non-cleaning mode, the process returns to S001.

Thus, it is possible to selectively execute one of the cleaning mode and non-cleaning mode.

S010

When it is selected to execute the non-cleaning mode, the system control section 200 causes the memory 208 to store the non-cleaning mode flag.

S011

The system control section 200 causes the cleaning mechanism control section 203 to rotate the web attaching/detaching motor 209 such that the collector roller 62 separates from the fixing belt 42.

By separating the collector roller 62 from the fixing belt 12, the collector roller 62 and the fixing belt 42 do not rub each other. Therefore, it is possible to prevent an increase in driving torque of the pressure rotary member 41, caused by friction between the collector roller 62 and the fixing belt 42.

S012

The system control section 200 determines the basis weight of a recording medium to be passed through the fixing unit 9. It is possible to determine whether to change over the target fixing temperature in accordance with the basis weight of a recording medium.

S013

The system control section 200 causes the fixing unit control section 201 to set the target fixing temperature of the fixing unit 9 to the target fixing temperature of the non-cleaning mode according to the basis weight of the recording medium, obtained in S012.

The target fixing temperature of the non-cleaning mode depends on the basis weight of a recording medium, and details are shown in FIG. 6.

When a recording medium with a basis weight less than or equal to the first predetermined basis weight is passed through the fixing unit 9, occurrence of offset is reduced by setting the target fixing temperature such that the target fixing temperature is lower than the target fixing temperature of the cleaning mode.

When a recording medium with a basis weight greater than or equal to the second predetermined basis weight is passed through the fixing unit 9, occurrence of offset is reduced by setting the target fixing temperature such that the target fixing temperature is higher than the target fixing temperature of the cleaning mode. Thus, occurrence of an image defect on a subsequent recording medium is reduced.

When the temperature of the fixing unit 9 becomes the target fixing temperature, the system control section 200 executes S011 and S015.

According to the embodiment of the present disclosure, even in a state where offset toner is not able to be collected by the web, it is possible to continue an image forming, process without decreasing the quality of an image.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-054576, filed Mar. 29, 2021, which is hereby incorporated by reference herein in its entirety.

What is claimed is:

1. An image forming apparatus comprising:

a heating rotary member arranged to heat an unfixed toner image born on a recording medium;

a pressure rotary member arranged to pressurize the heating rotary member;

a nip portion formed by the pressure rotary member and the heating rotary member and arranged to, when a recording medium bearing a toner image is conveyed to the nip portion, fix the toner image on the recording medium;

a temperature adjustment control section configured to control a temperature of the heating rotary member such that the temperature of the heating rotary member becomes a target temperature;

a cleaning web arranged to remove toner adhering to the heating rotary member; and a controller configured to execute one mode from among a plurality of modes including a cleaning mode in which the cleaning web cleans toner during image formation and a non-cleaning mode in which the cleaning web does not clean toner during image formation, wherein a first predetermined basis weight and a second predetermined basis weight greater than the first predetermined basis weight are set, and wherein a target temperature of a recording medium with the first predetermined basis weight in a case where the non-cleaning mode is executed is lower than a target temperature of the recording medium with the first predetermined basis weight in a case where the cleaning mode is executed.

2. The image forming apparatus according to claim 1, wherein a target temperature of a recording medium with the second predetermined basis weight in a case where the non-cleaning mode is executed is higher than a target temperature of the recording medium with the second predetermined basis weight in a case where the cleaning mode is executed.

3. The image forming apparatus according to claim 1, further comprising:

a collector roller arranged to be brought into contact with the heating rotary member and collect toner adhering to the heating rotary member; and a contact and separation unit arranged to bring the cleaning web into contact with and separate from the collector roller, wherein when the controller executes the non-cleaning mode, the contact and separation unit is arranged to separate the cleaning web from the collector roller.

4. The image forming apparatus according to claim 1, further comprising a control section configured to, when image formation is not able to be performed due to the cleaning mode, display a prompt to replace the cleaning web.

* * * * *